US009601890B1

(12) United States Patent
Jacques et al.

(10) Patent No.: US 9,601,890 B1
(45) Date of Patent: Mar. 21, 2017

(54) ELECTRICAL TERMINAL APPLICATOR WITH A COMPOSITE FRAME

(71) Applicant: ETCO, Inc., Warwick, RI (US)

(72) Inventors: Edward H Jacques, Sarasota, FL (US); Cris S Gravel, Foster, RI (US)

(73) Assignee: ETCO, Inc., Warwick, RI (US)

( * ) Notice: Subject to any disclaimer, the term of this patent is extended or adjusted under 35 U.S.C. 154(b) by 221 days.

(21) Appl. No.: 14/586,194

(22) Filed: Dec. 30, 2014

Related U.S. Application Data

(60) Provisional application No. 61/922,072, filed on Dec. 30, 2013.

(51) Int. Cl.
*H01R 43/048* (2006.01)

(52) U.S. Cl.
CPC ..... *H01R 43/048* (2013.01); *Y10T 29/53235* (2015.01)

(58) Field of Classification Search
CPC ..... H01R 43/048; Y10T 29/53235
See application file for complete search history.

(56) References Cited

U.S. PATENT DOCUMENTS 4,019,362 A * 4/1977 McKeever ..... H01R 43/04 226/167
2007/0062246 A1* 3/2007 Imgrut ..... H01R 43/055 72/420
2008/0172874 A1* 7/2008 Yagi ..... H01R 43/0486 29/861
2011/0099801 A1* 5/2011 Particka ..... H01R 43/048 29/753

* cited by examiner

*Primary Examiner* — Livius R Cazan
(74) *Attorney, Agent, or Firm* — Altman & Martin; Steven K Martin

(57) ABSTRACT

An electrical terminal applicator with a molded frame composed of a polymer base material mixed with 10% to 25% total weight of a reinforcing material such as glass fiber or carbon fiber. Prior to injecting the mixture into a mold, steel inserts for attaching various components are installed in the mold. A feed mechanism feeds a terminal strip into a crimp region. A plunger with a crimp punch reciprocates vertically within a plunger channel in the frame. An anvil is mounted to the base plate and extends into the crimping region. The punch and anvil are shaped to crimp the terminal to the wire conductor.

8 Claims, 5 Drawing Sheets

ELECTRICAL TERMINAL APPLICATOR WITH A COMPOSITE FRAME

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical contacts, more particularly, to apparatuses for attaching electrical terminals to wire conductors.

2. Description of the Related Art

Electrical terminals are used to terminate the conductor(s) of electrical wires and cables. The typical electrical terminal has a contact portion and a crimp portion for attaching the wire conductor. The crimp portion can be cylindrical, known in the industry as "closed barrel", or "U"-shaped, known as "open barrel." Typically, the wire or cable is stripped of its jacket or insulation to expose the conductor, the conductor is inserted into the crimp portion, and the terminal is crimped to the conductor to form a mechanical bond between the conductor and the terminal. This bond must be solid to ensure integrity and robustness.

The use of mechanical devices to attach electric terminals to wire is well-known in the industry. Electrical terminals have been crimped to wire, either manually, semi-automatically, or automatically, in close tolerance machinery such as applicators and presses. The applicator precisely positions the terminal at a location where the tooling portion of the applicator can squeeze the crimp portion around the wire conductor to form a crimped bond. A press supplies the force and motion needed by the applicator to repeat this cycle many times.

An applicator 14 of the prior art is shown in FIG. 1. The applicator 14 includes a metal frame 1, a plunger or ram 2, a crimp punch 3, an anvil 4, guides 5, a brake 6, a base plate 7, plunger caps 10, a terminal advancing mechanism or feeder mechanism 8, a feeder adjustment 15, and a crimp height adjustment mechanism 9. The applicator 14 is used in conjunction with a press, not shown. The press provides motion and force for the applicator to advance, fixture, and compress a terminal's crimping portion securing it to the wire conductor.

It is common to produce applicator components, including the applicator frame, from metals of various types. These metals can be ferrous or non-ferrous, in block or cast form, and may be iron, steel, aluminum, bronze, or other metals and/or alloys. A strong material is needed to provide a solid platform and guide to which most of the applicator's components are attached or interfaced.

Machining a frame from a block of metal or casting a frame with a form can provide a solid foundation but there are many shortcomings inherent to the use of metals and the production methods used to produce metal frames. Complex geometries machined to close tolerances are needed for a quality finished product. As shown in FIG. 2, milling used at 17, drilling used at 18, tapping used at 19, grinding used at 20, reaming used at 21, and de-burring used at 22, are some of the procedures used to manufacture a metal frame. Electrical discharge machine (EDM) used at 23 is another subtractive manufacturing process used to remove raw material in the construction of a metal frame. These methods require special tools, handling, fixturing, and time, and must be repeated for each frame. Consequently, the turnaround time to order and receive a new or replacement applicator can be several weeks.

Iron, aluminum, steel and most feasible alloys are subject to some form of corrosion. Finished metal frames are typically painted or coated, and these processes require additional steps such as cleaning, degreasing and masking.

Additionally, the price of the metals and the perishable tooling can greatly add to the cost of the frame.

Applicator frames made of steel or iron are heavy. Ergonomic issues like the weight of the applicator and its location in the press can make set-ups and re-sets of the applicator cumbersome and time-consuming.

During operation, the feeder 8 positions the terminal 13 above the anvil 4. After the conductor 12 is inserted into the crimp portion, the press pushes the plunger 2 downwardly. This action brings the crimp punch 3 into contact with the crimp portion, compressing it against the anvil 4, thereby forming the terminal-to-wire crimp bond. The effectiveness of the crimp is dependent on the integrity of the frame 1 and its ability to rigidly guide and maintain the precise location of the applicator components and mechanisms for many cycles.

Frames of metal construction are not efficiently designed to dissipate heat. Consequently, after several hours of cycling, the temperature of the applicator frame can rise. This thermal instability affects the fixture's ability to hold dimensional tolerances of the finished crimp, leading to the need to make adjustments to the equipment. However, the heat can also make the equipment uncomfortably hot to the touch for the technician making the adjustments, inviting potential safety concerns.

There exist in the industry needs for improvements to the applicator in order to improve the overall efficiency of the automated and semi-automated crimping process.

BRIEF SUMMARY OF THE INVENTION

An electrical terminal applicator is a precision apparatus used to mechanically bond an electrical terminal to a wire conductor. The applicator incorporating the present invention includes a frame, plunger, crimp punch, anvil, stock/terminal strip guides, base plate, plunger caps, terminal feeder mechanism, a feeder adjustment mechanism, and a crimp height adjustment mechanism.

The frame and guide pad are mounted to the base plate. The strip guides are mounted to the guide pad to guide the terminal strip horizontally from a spool. The feeder mechanism pushes the terminal strip through the guides into a crimping region.

The plunger reciprocates vertically within a plunger channel in the frame and is retained in the channel by plunger caps. The plunger top end is attached to a press that provides the force needed for the applicator to operate. The punch is secured to the plunger so that the bottom end of the punch extends into the crimping region.

The anvil is mounted to the base plate so that it extends into the crimping region. The punch and anvil are shaped to create the crimp to mechanically bond the terminal to the wire conductor.

The feeder mechanism has a piston that is reciprocated horizontally by an angular surface on the plunger. An arm extends from a pivoting attachment on the piston through a pivot point mounted to the frame to a feed finger. As the piston reciprocates away from the plunger, the arm pivots on the pivot point moving the feed finger to push the terminal strip toward the crimping region.

When the terminal is in the crimping region, the conductor is inserted into the crimp portion of the terminal. The press pushes the plunger downwardly, squeezing the terminal between the anvil and punch to precisely form the crimp around the conductor.

The frame is produced in a molding process using a polymer base material mixed with a percentage of a reinforcing material, such as glass fiber, carbon fiber or ceramic powders to form a mixture. The mixture forms a composite material that, when molded, cures to form a frame with many characteristics superior to those of a metal frame.

Prior to injecting the mixture into a mold, pre-machined stainless steel inserts are installed in the mold. The mixture is heated to a liquid and injected into the mold cavity. Upon completion of the molding cycle, a completely finished frame is removed from the mold cavity.

Other embodiments of this invention include frames designed for applicators where the terminals are being presented to the crimp process from the right or rear.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. Provisional Patent Application No. 61/922,072, on which this application is based.

An electrical terminal applicator is a precision apparatus used to mechanically bond an electrical terminal to a wire conductor. The apparatus is typically used in industries where production requirements demand 1000's of terminations be made daily to tolerances often specified to 1/1000 of an inch.

Figure 1:
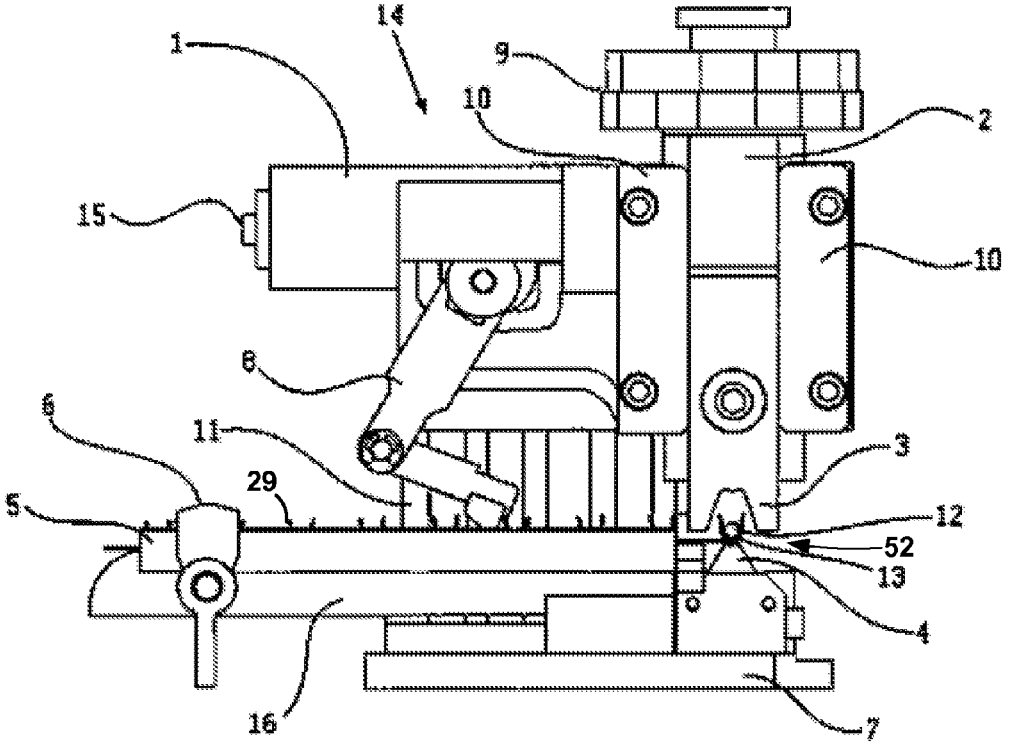
FIG. 1 Prior Art
FIG. 1 is an isometric side view of a prior art applicator with terminal strip and wire.
Figure 2:
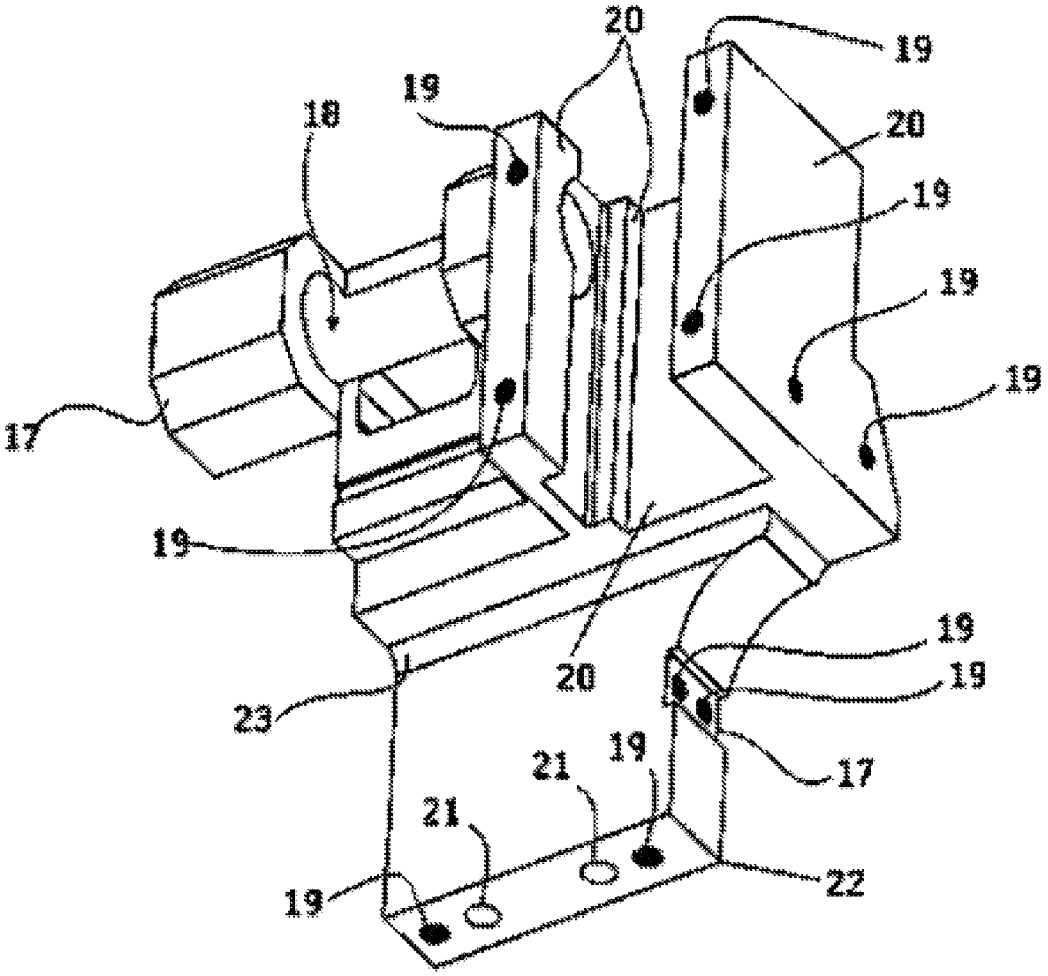
FIG. 2 Prior Art
FIG. 2 is a perspective view of a prior art machined metal applicator frame showing areas where different methods of machining might be used during production.
Figure 3:
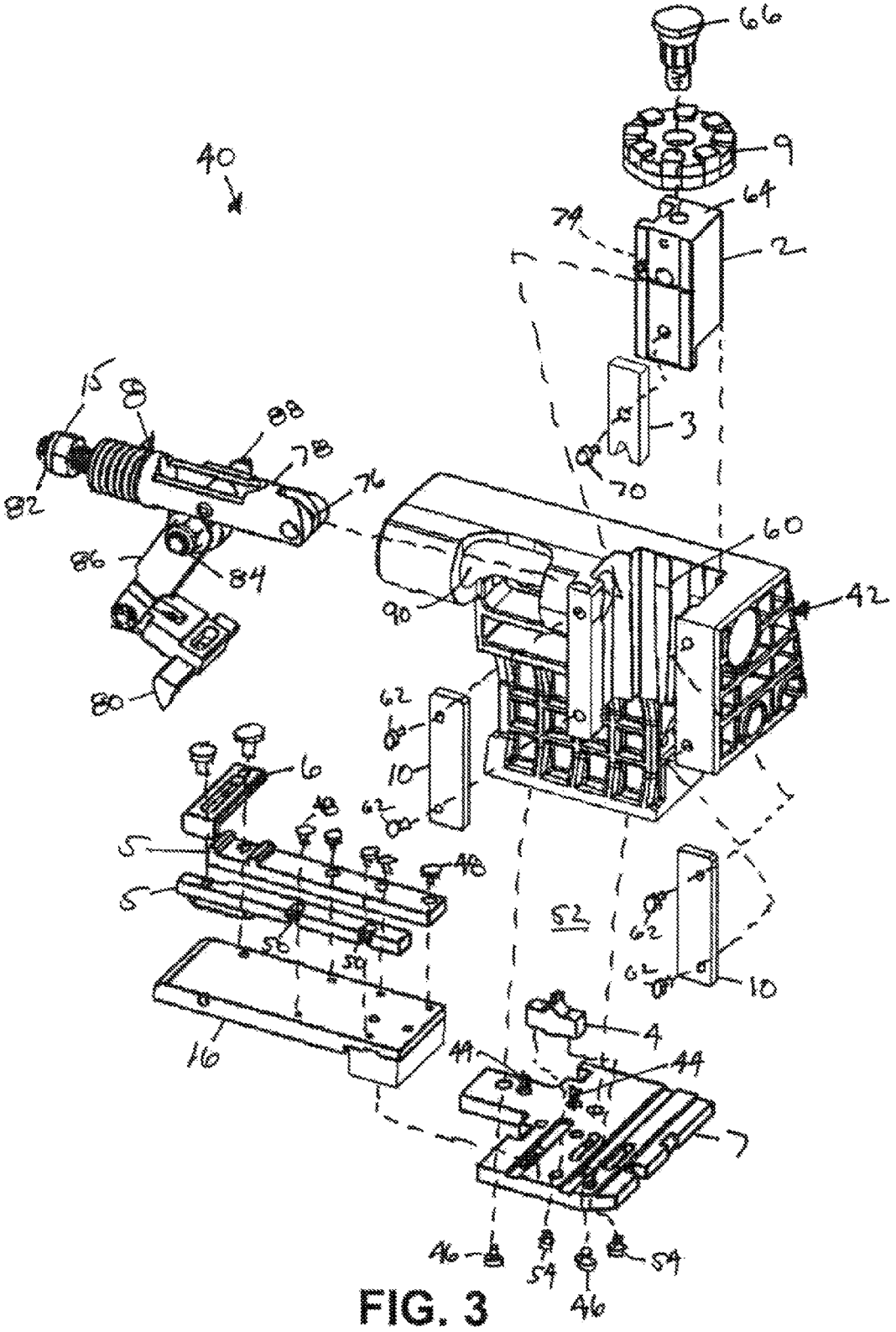
FIG. 3 is an exploded view of an applicator with the frame of the present invention.

An applicator 40 incorporating the present invention has most of the same components as the prior art applicator of FIG. 1, an exploded view of which is shown in FIG. 3. The applicator 40 includes a frame 42, a plunger 2, a crimp punch 3, an anvil 4, stock/terminal strip guides 5, a terminal brake 6, a base plate 7, plunger caps 10, a terminal feeder mechanism 8, a feeder adjustment mechanism 15, and a crimp height adjustment mechanism 9. The applicator 20 is used in conjunction with a press, not shown, that provides motion and force for the applicator to advance, fixture, and compress a terminal's crimping portion securing it to the wire conductor.

The frame 42 is mounted to the base plate 7, typically by screws 46 into threaded inserts 30, as described below.

A guide pad 16 is mounted to the base plate 7. The stock/terminal strip guides 5 are mounted to the guide pads 16 so as to guide the terminal strip 29 horizontally from a spool. Screws 48 through elongated slots 50 are used so that the position of the guides 5 can be adjusted for different sized terminal strips 29. The feeder mechanism 8 pushes the terminal strip 29 horizontally through the guides 5 into a crimping region 52, as described below. The distance the feeder mechanism 8 pushes the terminal strip 29 for each crimp cycle is adjusted by a feeder adjustor 15.

The anvil 4 is mounted to the base plate 7, typically by screws 54, so that the upper end of the anvil 4 extends into the crimping region 52.

The plunger 2 is mounted to reciprocate vertically within a plunger channel 60 in the frame 42. The plunger caps 10 retain the plunger 2 in the channel 60 and can be composed of any adequate rigid material. Currently, the plunger caps 10 are made of a machine-oil-impregnated bronze. The plunger caps 10 are secured to the frame 42 outside the channel 60 with screws 62. The top end 64 of the plunger 2 is attached to a piston of a press, not shown, by a screw 66. The press is a machine that provides the motion and force needed for the applicator 40 to crimp by pushing and pulling the plunger 2 downwardly and upwardly, respectively, through the channel 60. When fully downward, the plunger 2 is in the crimping position and when fully upward, the plunger 2 is in the feeding position.

The punch 3 is secured to the plunger 2, typically by a screw 70, so that the bottom end of the punch 3 extends into the crimping region 52 above the anvil 4 when the plunger 2 is in the crimping position. The punch 3 and anvil 4 are formed devices that ultimately create the crimp to mechanically bond the terminal 13 to the wire conductor 12.

The feeder mechanism 8 feeds a terminal 13 a preset distance into the crimping region 52 between the punch 3 and anvil 4. The feeder mechanism 8 is cyclically operated through the vertical motion of the plunger 2. An angular surface 74 on the vertically-moving plunger 2 pushes a roller 76 on the end of a horizontally fixtured, spring-loaded piston 78 so that the piston 78 reciprocates horizontally within a channel 90 in the frame 42. An arm 86 extends from a pivoting attachment 88 on the piston 78 through a pivot point 84 mounted to the frame 42 to a feed finger 80. As the piston 78 reciprocates horizontally away from the plunger 2, the arm 86 pivots on the pivot point 84 moving the feed finger 80 to push the terminal strip 29 toward the crimping region 52. As the piston reciprocates horizontally toward the plunger 2, the feed finger 80 moves away from the crimping region 52 for the next cycle. The brake 6 prevents the terminal strip 29 from reversing direction when the feed finger 80 moves back.

An adjustment screw 82 alters the horizontal position of the pivot point 84 relative to the piston 78 in order to increase or decrease the distance the feed finger 80 pushes the terminal strip 29 into the crimping region 52.

Once the terminal 13 is in the crimping region 52, the conductor 12 is inserted into the crimp portion of the terminal 13. The manner by which the conductor 12 is inserted depends on the particular system. In most apparatuses, the conductor 12 is inserted manually, where the wire is pushed into the barrel to a wire stop. In other apparatuses, the conductor is inserted robotically. The press pushes the plunger 2 downwardly, squeezing the terminal between the anvil 4 and punch 3 to precisely form the crimp around the conductor 12. The crimp height adjustor 9 determines the lowest point of the plunger height, thereby increasing or decreasing overall crimp height.

A repeatedly precise crimp from a terminal applicator 40 requires that the punch 3 and anvil 4 engage the wire conductor 12 and crimp portion of the terminal 13 in exactly the same way with each cycling of the apparatus. To accomplish this, an applicator's components must be precisely fabricated and fixtured.

As is clear from the preceding description, the marriage of all the components is accomplished through the applicator frame 42. The frame 42 is screwed and doweled to the base plate 7. The stock/terminal strip guides 5 and the anvil 4 are secured to the base plate 7. The punch 3 is attached to the plunger 2 which is guided by the frame's plunger channel 60. The plunger's vertical motion in the channel 60 is the source for the perpendicular movement needed to energize the feeder 8.

Figure 4:
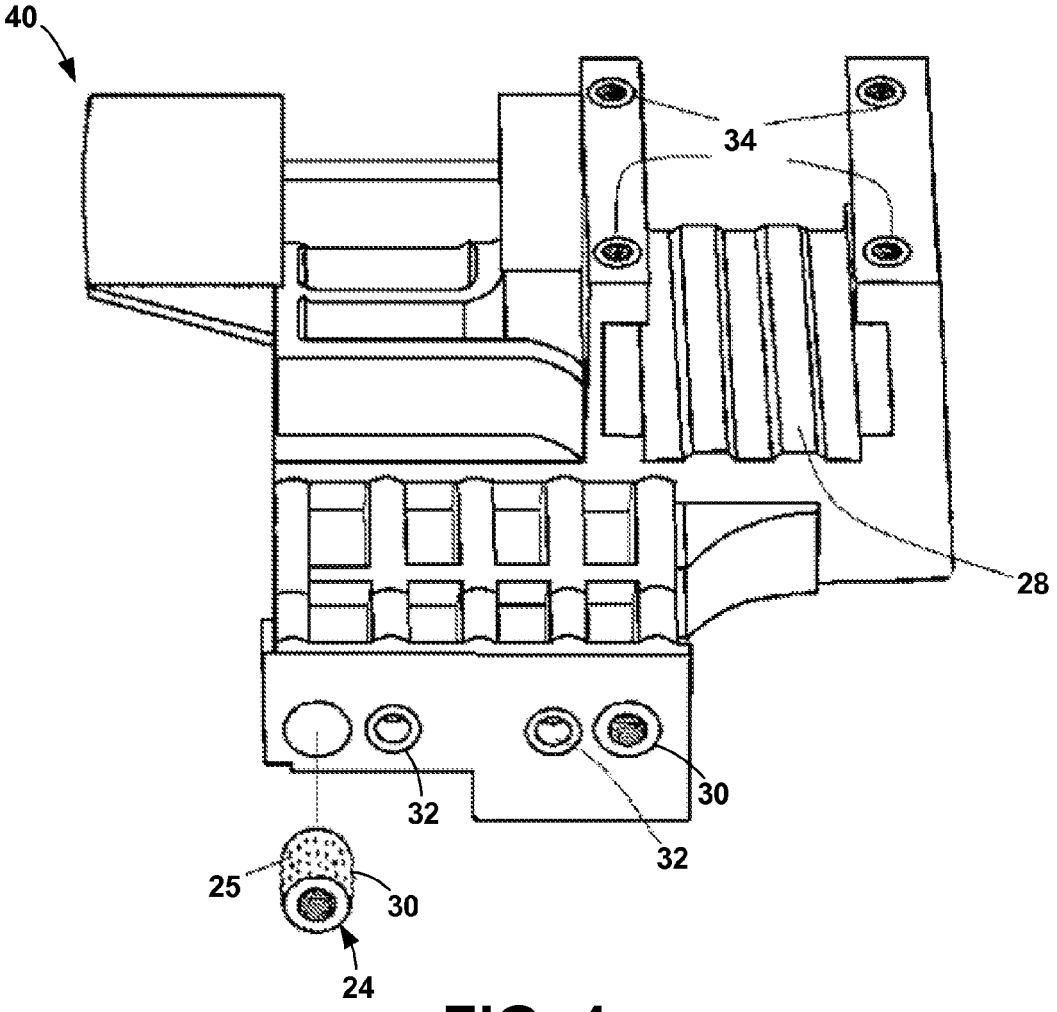
FIG. 4 is a perspective view of the composite applicator frame of the present invention as viewed from the bottom and side.
Figure 5:
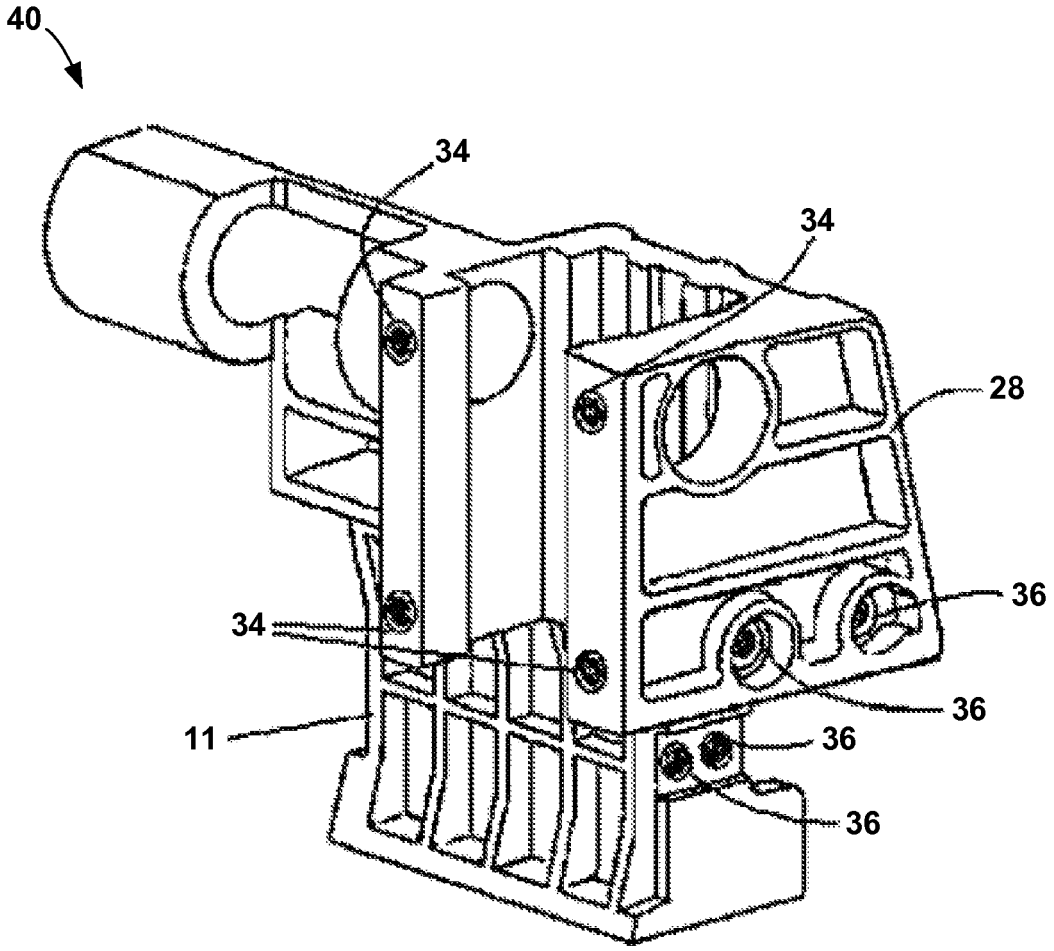
FIG. 5 is an isometric view of the present invention from the right front side.

The main aspect of the present invention is an electrical terminal applicator frame 42 that is composed of a carbon composite material mixed with some percentage of other organic or inorganic materials. The frame 42 can be designed as a replacement for existing metal frames 1 or it can be custom designed as part of a new applicator design. The composite applicator frame 42 of the present invention is shown in FIGS. 4 and 5.

The frame 42 of the present invention reduces set up time, improves safety concerns, and provides characteristics affording the ability to dissipate heat buildup. The thermal stability of the frame 42 yields more precise control of the applicator feeder mechanism and crimp tooling, allowing stricter containment of tolerances.

The frame 42 of the present invention is produced in a molding process using engineered thermoplastics or polymers like acetyl or nylon as the matrix or base material. The base material is mixed with a percentage of a reinforcing material, either glass fiber, carbon fiber, or ceramic powders, to form a mixture. Typical glass fiber percentages added to the base material range from 10% to 25% of total weight. Fiber diameters ranging from 0.0008 inches to 0.002 inches with a length to diameter aspect ratio of approximately 20:1 offer uniform rigidity and optimal retention of over-molded inserts, discussed below. The mixture forms a composite material that, when molded, cures to form a frame 42 with many characteristics superior to those of a metal frame 1.

Prior to injecting the mixture into a mold, pre-machined stainless steel inserts 24 are installed in the mold. The inserts 24 are snuggly fit to locator pins precisely positioned within the mold. The inserts 24 have external features like ridges, grooves, barbs, or gills 25 for retention by the over-molded mixture. The actual characteristics of the external features depend on the mixture.

The inserts 24 have specific internal features depending on the purpose of the insert 24. Some inserts 24 have internal threads 26 for tapped hole requirements. Other inserts have reamed inside surfaces 27 for details requiring bushings or pins.

The bottom of the frame 42 has over-molded threaded inserts 30. These inserts 30 are used to secure the frame 42 to the base plate 7 with the mounting screws 46. The bottom of the frame 42 can have over-molded reamed inserts 32 that accept pins 44 to orient and maintain the geometric relationship of the frame 42 to base plate 7. Over-molded threaded inserts 34 located on the outside of the plunger channel 60 accept the screws 62 that attach the plunger caps 10. Additionally, there are over-molded threaded inserts 36 located on the exit side of the applicator 40 for securing accessories such as wire stops, applicator guards/shields, etc.

The mixture is heated to a liquid and is injected into the mold cavity. Upon completion of the molding cycle, a completely finished frame is removed from the mold cavity. Optionally, a finish skim is applied to the plunger channel 60.

Optional features can be designed into the mold where additional functionality may be desired. For example, the ribs 11, 28 shown in FIG. 5 can be added to provide additional stability.

The high strength and rigid composite frame assembly of the present invention offers the industry a lighter and robust option to the use of metal.

Mold making techniques, material selection and component design allow for the creation of a finished applicator frame right out of the mold. A completely finished composite applicator frame can be produced in a few minutes by a process with few steps. It is a significant reduction in the amount of time needed to fixture, machine, clean, and paint a metal applicator frame. The resulting finished product is a rugged, close tolerance, dimensionally stable platform to which the applicator components can be attached.

The abrasion resistant, low friction attributes of the composite frame eliminate the need for lubrication where the frame interfaces with other applicator components.

The composite frame assembly is not subject to deterioration due to effects of corrosion.

An optional color pigment can be added to the material mix to eliminate the need to paint the frame.

Other embodiments of this invention include frames designed for applicators where the terminals are being presented to the crimp process from the right or rear.

Thus it has been shown and described a composite frame for an electrical terminal applicator. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An electrical terminal applicator comprising:

(a) a base plate;

(b) a frame mounted to the base plate and having a plunger channel, the frame being composed of a hardened mixture of a polymer base material mixed with a reinforcing material selected from the group consisting of glass fibers, carbon fibers, and ceramic powders, the reinforcing material comprising between 10% and 25% of the total weight of the mixture;

(c) a plunger mounted to reciprocate within the plunger channel, and adapted to be reciprocated by a press between a crimping position and a feeding position;

(d) a feeder mechanism adapted to feed an electrical terminal into a crimping region when the plunger is in the feeding position;

(e) an anvil extending from the base into the crimping region;

(f) a crimp punch attached to the plunger and being positioned on the plunger such that, when the plunger is in the crimping position, the crimp punch crimps the electrical terminal in the crimping region between the crimp punch and the anvil and, when the plunger is in the feeding position, the crimp punch is separated from the anvil.

2. The electrical terminal applicator of claim 1 wherein the reinforcing material is glass fibers having diameters in the range of from 0.0008 inches to 0.002 inches and a length to diameter aspect ratio of approximately 20:1.

3. The electrical terminal applicator of claim 1 wherein the frame is mounted to the base plate via screws turned into threaded inserts over-molded into the frame.

4. The electrical terminal applicator of claim 1 wherein the feeder mechanism includes a spring-loaded piston mounted to reciprocate within a piston channel perpendicular to the plunger channel, an arm mounted to pivot and having one end attached to the piston and the other end having a feed finger adapted to feed the electrical terminal into the crimping region as the piston reciprocates, the piston being driven to reciprocate by the plunger.

5. The electrical terminal applicator of claim 1 wherein the plunger is retained in the plunger channel by plunger caps, the plunger caps being attached to the frame by screws turned into threaded inserts over-molded into the frame adjacent to the plunger channel.

6. The electrical terminal applicator of claim 1 wherein the frame includes ribs for stability.

7. The electrical terminal applicator of claim 1 wherein the crimp punch is removably attached to the plunger.

8. The electrical terminal applicator of claim 1 wherein the anvil is removably attached to the base.

* * * * *